US009687078B2

(12) United States Patent
Mitchell

(10) Patent No.: US 9,687,078 B2
(45) Date of Patent: Jun. 27, 2017

(54) PORTABLE THERAPEUTIC SEAT DEVICE

(71) Applicant: Michelle D. Mitchell, Lithia Springs, GA (US)

(72) Inventor: Michelle D. Mitchell, Lithia Springs, GA (US)

( * ) Notice: Subject to any disclaimer, the term of this patent is extended or adjusted under 35 U.S.C. 154(b) by 0 days.

(21) Appl. No.: 14/921,214

(22) Filed: Oct. 23, 2015

(65) Prior Publication Data

US 2016/0174717 A1 Jun. 23, 2016

Related U.S. Application Data

(60) Provisional application No. 62/094,524, filed on Dec. 19, 2014.

(51) Int. Cl.

| | |
|---|---|
| ***A47C 7/02*** | (2006.01) |
| ***A47C 7/54*** | (2006.01) |
| ***A47C 7/40*** | (2006.01) |

(52) U.S. Cl.

CPC ..... *A47C 7/022* (2013.01); *A47C 7/021* (2013.01); *A47C 7/407* (2013.01); *A47C 7/54* (2013.01)

(58) Field of Classification Search

CPC ..... A47C 7/022; A47C 7/021; A47C 7/407; A47C 7/54

USPC .. 297/255, 256, 352, 452.21, 452.22, 378.1, 297/452.25

See application file for complete search history.

(56) References Cited

U.S. PATENT DOCUMENTS

| | | | | |
|---|---|---|---|---|
| 4,161,337 | A | 7/1979 | Ross et al. | |
| 4,362,334 | A | 12/1982 | Ross et al. | |
| 5,123,699 | A * | 6/1992 | Warburton | A61G 5/1043 297/256 |
| 5,288,135 | A * | 2/1994 | Forcier | A47C 7/022 297/452.21 |
| 5,407,247 | A | 4/1995 | Forcier et al. | |
| 5,496,092 | A * | 3/1996 | Williams | A61F 5/3792 297/250.1 |
| 6,840,577 | B2 * | 1/2005 | Watkins | A61G 5/1064 297/284.9 |
| 7,475,941 | B2 | 1/2009 | Clement et al. | |
| 7,857,385 | B2 * | 12/2010 | Zink | B60N 2/2851 297/256 |
| 8,511,747 | B2 | 8/2013 | Lougee | |
| 8,690,236 | B2 | 4/2014 | Gorinas et al. | |
| 2010/0038943 | A1 | 2/2010 | Bryer | |

* cited by examiner

*Primary Examiner* — Anthony D Barfield

(74) *Attorney, Agent, or Firm* — J. T. Hollin, Attorney at Law, P.C.

(57) ABSTRACT

The disclosed invention provides a seating device for use by individuals who have recently had a surgical procedure that makes it uncomfortable or painful for the person to bear their body weight on their buttocks region. The device includes a firm back support and a cushioned bottom portion having a contoured recess thereon, thereby allowing an individual to place their body weight on the thigh area rather than directly onto the buttocks, offering comfort while sitting. The back support is connected to the bottom portion by a hinge, enabling the back support to fold down on the seat for easy and convenient portability. Overall, the present invention allows people to go about their daily routines without worry of additional discomfort when sitting down at home, at work, during vehicular transit, or other situations.

9 Claims, 4 Drawing Sheets

PORTABLE THERAPEUTIC SEAT DEVICE

CROSS-REFERENCES TO RELATED APPLICATIONS

This application claims the benefit of priority of U.S. Provisional Application, Ser. No. 62/094,524, filed on Dec. 19, 2014, and the provisional application is incorporated by reference as though fully appearing herein.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The disclosed inventive concept relates to seats, chairs, and devices used for cushioned and/or contoured support of certain parts of the human body. More particularly, the inventive concept herein is a specific design and construction of a seating device which supports the hamstring muscles and back of a user while simultaneously providing a concave bottom segment specifically contoured to the buttocks area of the anatomy. The disclosed device is intended to provide a supporting cushion and weight-bearing section for a person's thighs and back while the person is seated for extended periods of time. This particular design thereby eliminates or minimizes discomforting or painful contact of the buttocks area with a chair or other type of seating.

Devices are known that relate to seats and thigh supports. Some devices provide improved seat attachments consisting of two divided panels molded to curve up on the outer edge for those who have pain or discomfort sitting on a regular seat. Other devices provide seats having individual supports for the lower thigh of the user which are pivotally mounted at the front of the seat portion. However, these known devices provide a chair having a seat panel adapted to support the hamstrings and do not provide a seat that places the person's weight on the user's thighs rather than on their buttocks.

(2) Description of the Related Art, Including Information Disclosed Under 37 CFR 1.97 and 1.98

U.S. Pat. No. 8,690,236 B2 (Apr. 8, 2014) An apparatus includes a frame having a collapsed configuration and an expanded configuration. A first membrane is coupled to the frame and includes a seat portion with first and second openings. A second membrane is couplable to the first membrane and/or the frame and is configured to be moved between a first position in which the second membrane covers the first and second openings, and a second position in which the first and second openings are not covered by the second membrane. The frame and the first membrane are configured to support a user in a seated position when the second membrane is in the first position and the frame is expanded, the first and second openings are each configured to receive a leg of a user when the second membrane is in the second position and the frame is expanded to support the user in a standing position.

U.S. Pat. No. 8,511,747 B2 (Aug. 20, 2013) A collapsible chair includes a collapsible seat having a front portion and an opposing rear portion and a collapsible back. The collapsible back includes a first back support member and a second back support member. Each of the first back support member and the second back support member includes an arcuate portion extending toward the front portion of the collapsible seat. A back membrane is coupled to the back support members and spans a distance between the back support members.

US #2010/0038943 A1 (Feb. 18, 2010) An ergonomical seat assembly for supporting a seated human body in correct posture to maintain proper and healthy spine, hip, and pelvic alignment. The seat assembly includes a back panel for supporting the back of a user in an upright sitting position and side support members for engaging the sides of the user's torso. Included is a lumbar support member for engaging the lower back of the user just above the hips. The back panel is secured to a base panel upon which is arranged hip support members for engaging the seated user's hips. Together the elements of the seat assembly maintain proper and healthy posture of a seated user and comfortable long or short term seating.

U.S. Pat. No. 7,475,941 B2 (Jan. 13, 2009) The unique folding child vehicle seat (10) includes a seat back member (12) and a seat bottom member (14) that is pivotally connected thereto. The seat bottom (14) is pivotally connected to the seat back (12) in the unique location of a selected distance from the bottom edge of the seat back member. A support member (42) is provided proximal to the bottom edge of the seat back (12). The seat bottom member (14) is pivotable between a closed position where the lower surface of the seat bottom member (14) rests on the support member (42) to provide a unique cantilevered seat configuration. Vertically oriented plates (32*a*, 32*b*, 34*a*, 34*b*) provide an internal framework for added strength. Also, the seat (10) may be of a non-folding configuration where L-shaped vertically oriented plates (202*a*, 202*b*) provide the internal framework.

U.S. Pat. No. 5,407,247 (Apr. 18, 1995) A seat cushion for prolonged sitting, having a thigh cushion coupled to and spaced apart from a back cushion. A seat well is defined between the thigh cushion and the back cushion to remove pressure from the buttocks region. Coupling members couple the thigh cushion and the back cushion, and extend therebetween on either side of the seat well.

U.S. Pat. No. 4,362,334 (Dec. 7, 1982) A portable folding orthopedic seat unit for use on a chair, automobile seat, or the like. A seat member is hinged to a back member. Vertical tracks extend from the bottom to the top of the back member and support a back-support assembly, comprising two separate, generally elliptically-shaped, centrally extending padded back-support members, spaced apart from each other, and a connecting member joining them together. The connecting member also serves to transfer forces from one back-support member to the other. Two strips that adhere to each other on contact are used to hold the assembly at a selected vertical position on the tracks.

U.S. Pat. No. 4,161,337 (Jul. 17, 1979) A portable folding orthopedic seat unit for use on a chair, automobile seat, or the like. A semirigid seat member is hinged to a back member. Vertical rigid support means extends from the bottom to the top of the back member and supports a back-support assembly, comprising two separate, generally elliptically-shaped, padded back-support members, spaced apart from each other, and a substantially vertically rigid and laterally flexing connecting member joining them together.

The connecting member serves to transfer forces from one back-support member to the other. Releasable locking means holds the assembly at a selected vertical position on the rigid support means.

BRIEF SUMMARY OF THE INVENTION

Briefly, to achieve the desired objects of the seating device disclosed, in accordance with a preferred embodiment thereof, provided is a contoured recess coupled to, and spaced apart from a back cushion by coupling members. An upwardly-facing concave segment is defined between the thigh cushion and the rear panel of the contoured recess, and bounded on both sides by coupling members. A lumbar support extends from the back cushion, providing correct posture for proper cushion operation. The buttocks area of an individual extends downward into the contoured recess, supported between the thigh cushion/top panel and the lumbar support backrest.

In a further embodiment, a seat cushion is provided which includes a unitary, normally generally planar sheet of flexible cushioning material with an opening formed therein, configuring the sheet into a back cushion, a thigh cushion and coupling members coupling the back cushion to the thigh cushion.

In yet another embodiment, there is provided an auxiliary cushion having coupling means for adjustably coupling it to the thigh cushion.

When individuals have surgical procedures such as hemorrhoid removal, child birth, Brazilian butt lift, or any other procedure involving the back side of the body, it can be very uncomfortable or painful to sit down normally for long periods of time. For a period of time following the above-described surgical procedures, weight placed on the buttocks area can be intolerable after just a short time of sitting down. Additionally, an individual may cause damage to the area near the surgical site if they try to frequently place themselves in a sitting position. With these sitting restrictions, a person may feel their social life being restricted and become incredibly bored and frustrated. Some persons may not be able to travel in cars or even sit at their desk to work if the surgical procedure was extensive.

BRIEF DESCRIPTION OF THE VIEWS OF THE DRAWINGS

FIG. 5(*a*) depicts a circular cross-sectioned rod, threaded at both ends.

FIG. 5(*b*) is an enlarged view of a flat-head nut threaded to fit the circular rod.

FIG. 5(*c*) illustrates either the left or right hinge plate.

DETAILED DESCRIPTION OF THE INVENTION

The objects, features, and advantages of the inventive concept presented in this application are more readily understood when referring to the accompanying drawings. The drawings, totaling five figures, show the basic components and functions of the device and methods of use. In the several figures, like reference numbers are used in each figure to correspond to the same component as may be depicted in other figures.

Figure 1:
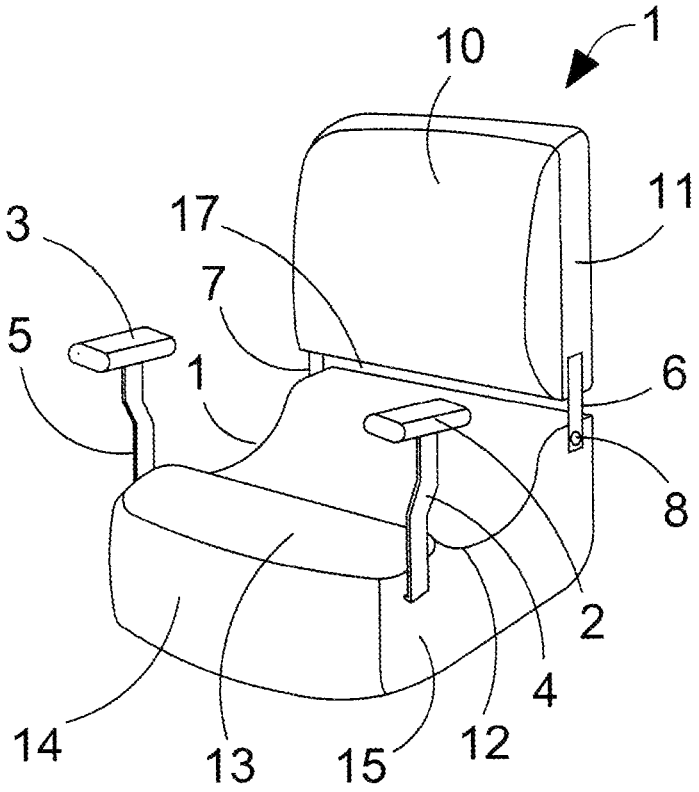
FIG. 1 illustrates a perspective, three-dimensional view of the seating device 1.

The discussion of the present inventive concept will be initiated with FIG. 1, which illustrates a front view of the seating device 1 in its open configuration. In the open configuration, the seating device 1 is receptive to a user 40 (not shown) sitting upon the seating device 1. The essential components of the seating device 1, as visible in FIG. 1, comprise a top panel 13, upon which a user's 40 thighs 45, 46 will rest; a contoured recess 12, which is contoured to correspond generally to a user's 40 buttocks 41, 42; an inner backrest 10, a back panel 11; a horizontally-oriented space 17; a left hinge 6 [shown in FIG. 5(*c*)] and left hinge bolt 8; a right hinge 7 (a right hinge bolt 9 is out of view); left and right armrests 2, 3; and left and right armrest supports 4, 5.

The contoured recess 12 is a solid, one-piece structure further comprising a top panel 13, a left side panel 15, a right side panel 16 not shown in FIG. 1), a forward front panel 14, a rear panel rear panel 18, and a continuous bottom edge 21.

Figure 2:
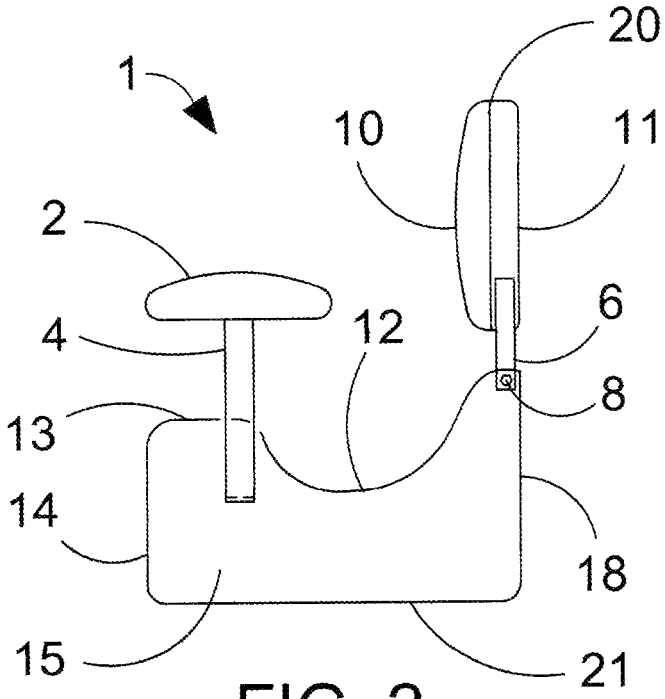
FIG. 2 presents a left side view of the seating device, prominently showing the contoured recess 12 and other frame members.

FIG. 2 presents a left-side view of the seating device 1, again in the open configuration. The rightmost portion of FIG. 2 shows the inner backrest 10 and the back panel 11. The inner backrest 10 comprises an elastomeric exterior surface which encloses an underlayment of cushioning material, while the back panel 11 is composed of a rigid material for vertical structural integrity. The inner backrest 10 and back panel 11 are permanently joined in an abutting manner at a common interfacing surface 20.

FIG. 2 also shows the lower section of the seating device 1, which essentially is the contoured recess 12. As shown in FIG. 2, the contoured recess 12 comprises a solid, box-like structure having a front panel 14, a top panel 13, a left side panel 15, (the right side panel 16 is out of view), a rear panel 18, and a bottom edge 21, which edge 21 is common to the bottom of the left and right side panels 15, 16, the bottom of the front panel 14, and the bottom of the rear panel 18. The left armrest 2 is shown, being permanently attached at the angle shown, to a left armrest support 4. In turn, the left armrest support 4 is permanently attached to the left side of the top panel 13. In a corresponding manner, the right armrest 3 (not shown) is attached to a right armrest support 5, the right armrest support 5 being attached to the right side of the top panel 13.

In FIG. 2, the contoured recess 12 is shown to be an arcuate, transverse padded channel which runs the entire width from the left side to the right side of the seating device 1. The contoured recess 12 is a continuous structure shaped so as to generally correspond to the roundness of a user's buttocks. Again referring to FIG. 2, the upper half of the left hinge plate 6 is permanently attached to the left side of, and parallel to, the back panel 11. Both hinge plates 6, 7, may also be manufactured as an integral part of the back panel 11. The left hinge plate 6 is constructed with an aperture proximate the lower end of the left hinge 6 so as to accommodate the insertion of a left hinge bolt 8. By the same design, the upper half of the right hinge 7 [shown in FIG. 5(*c*)] is permanently attached to the right side of, and parallel to, the back panel 11. The right hinge plate 7 is constructed with an aperture proximate the lower end of the right hinge plate 7 so as to accommodate the insertion of a right hinge bolt 9.

In FIG. 2, both sides of the contoured recess 12, near the rear panel 18, are constructed with two threaded horizontal openings: one on the upper left side panel 15 and one on the right side panel 16. The threaded horizontal openings correspond to the threading of the previously-mentioned left hinge bolt 8 and the right hinge bolt 9, respectively. During manufacture, the back panel 11, having the left hinge plate 6 and right hinge plate 7 permanently attached, is lifted into a position directly above the rear panel 18, so as to align the respective apertures of the left hinge plate 6 and right hinge plate 7 with the threaded openings on the left-side and right-side panels 15, 16. The left hinge bolt 8 and right hinge bolt 9 are then inserted through the respective hinge apertures and into the threaded openings on the left-side and right-side panels 15, 16. The left and right hinge plates 6, 7, may be of a variety of different designs and construction, including an arrangement providing a spring-loaded attachment to the back panel 18 or to both side panels 15, 16 of the contoured recess 12. Further, the left and right hinge plates In an alternative embodiment, the contoured recess 12 is configured with a horizontally-oriented circular channel extending the width of the seating device 1 from the rearmost portion of the left side panel 15 to the rearmost section of the right side panel 16. A corresponding circular, cross-sectioned rod 22 having a diameter corresponding to the inner diameter of said width-wise circular channel and a length corresponding to the length of said horizontally-oriented circular channel is included in the alternative embodiment. The said circular rod 22 further features exterior threading at both ends. The circular rod 22, once inserted into the circular channel, utilizes two threaded flat-head nuts 23, shown in FIG. 5(*a*), having internal threading corresponding to the exterior threads of said circular rod 22, to fasten both ends of the circular rod 22 securely against the left side panel 15 and right side panel 16 of the contoured recess 12.

Figure 3:
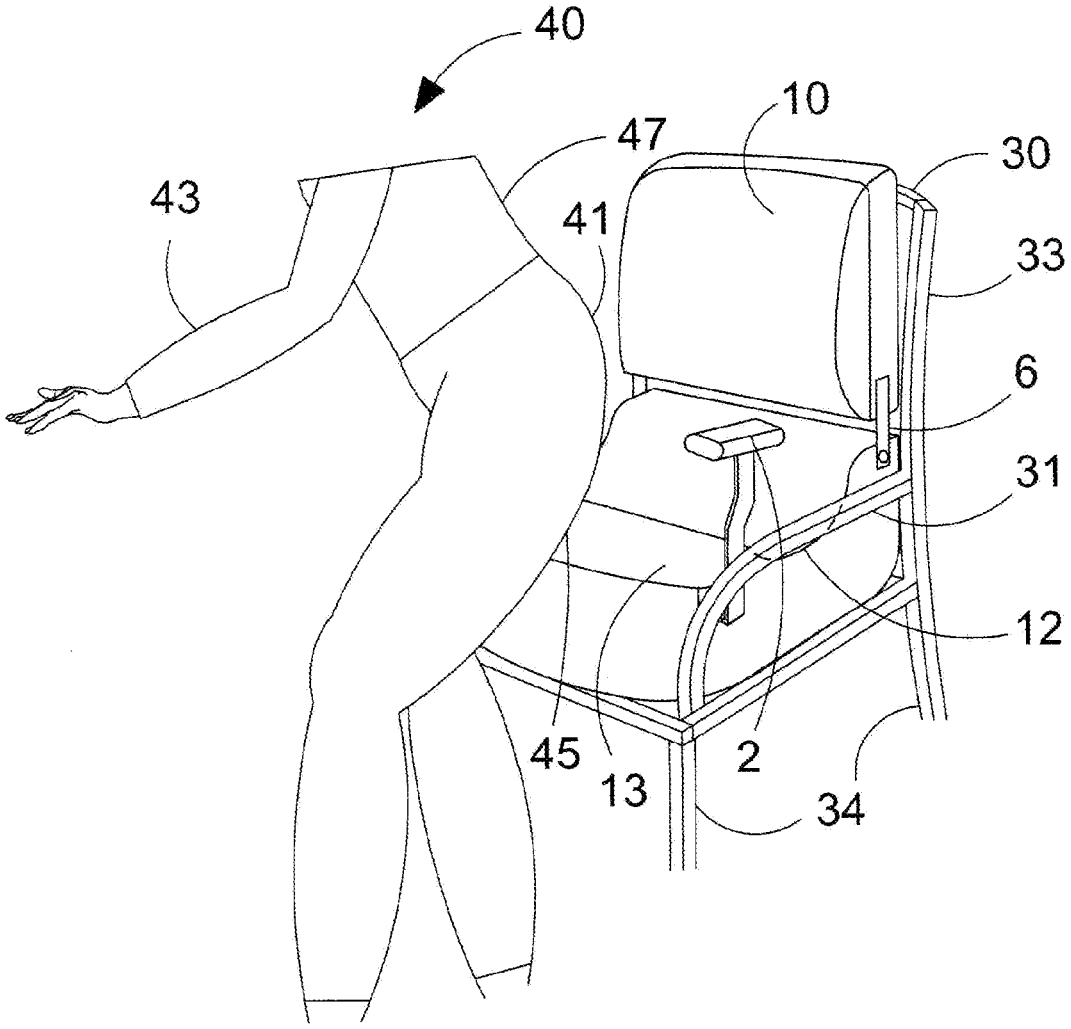
FIG. 3 depicts a user in the process of easing downward into a seated position within the confines of the seating device.

Viewing FIG. 3, there is shown a user 40 in the motion of lowering the body onto the seating device 1, with the left hamstring muscles 45 approaching contact with the top panel 13 of the contoured recess 12. The left arm 43 of the user 40 assists in giving balance during the seating process by providing a gradual shift of the user's 40 center of gravity. Once seated, the user's back 47 will make contact with the cushioned inner back rest 10, and the buttocks 41 will be suspended directly over the concave portion of the contoured recess 12.

Figure 4:
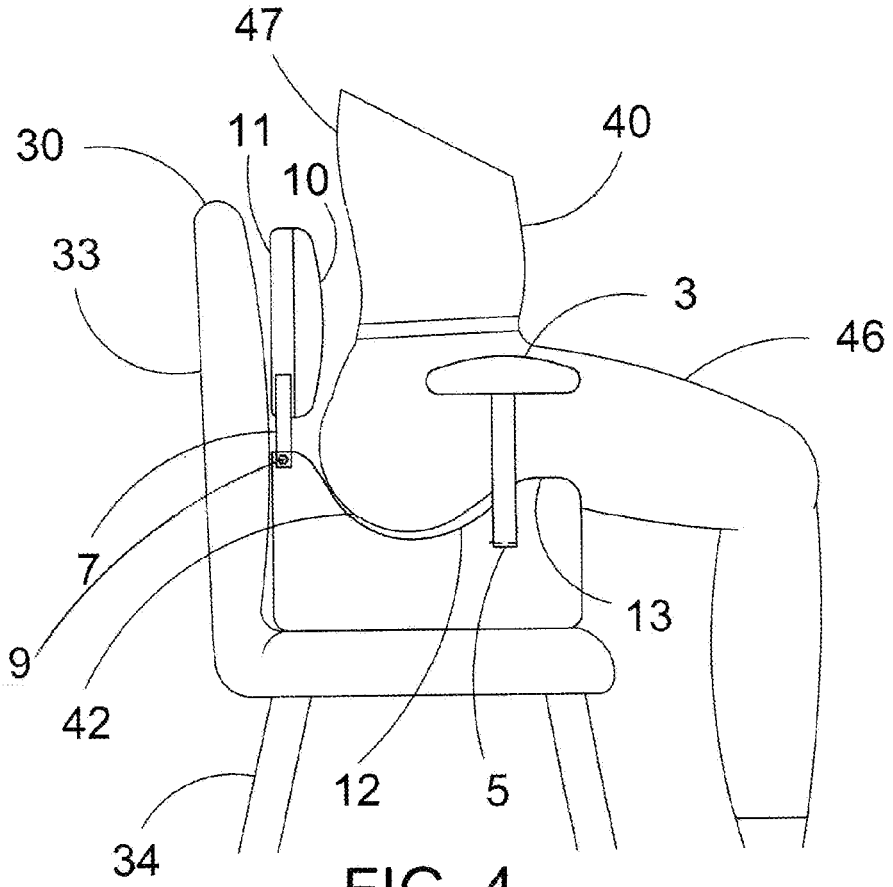
FIG. 4 is a right side view of the seating device being fully occupied, with the hamstring muscles of the user resting atop the top panel 13 of the seating device.

FIG. 4 illustrates a situation where the seating device 1 has been placed atop a chair 30 commonly found in residential or commercial settings. The back panel 11 of the seating device 1 is placed firmly against the chair back 33 and the bottom of the contoured recess 12 is placed in a level position upon the chair 30, corresponding to the horizontal of support provided by the chair 30 legs 34. A fully-seated user 40 is shown from the perspective of the right side of the seating device 1. The right hamstring muscles 46 of the user 40 are shown to be firmly supported by the top panel 13 of the contoured recess 12, and the back 47 of the user 40 may be firmly pressed against the cushioned back rest 10. The user's 40 buttocks 42 are seen to be suspended directly above the concave segment of the contoured recess 12.

Figure 5:
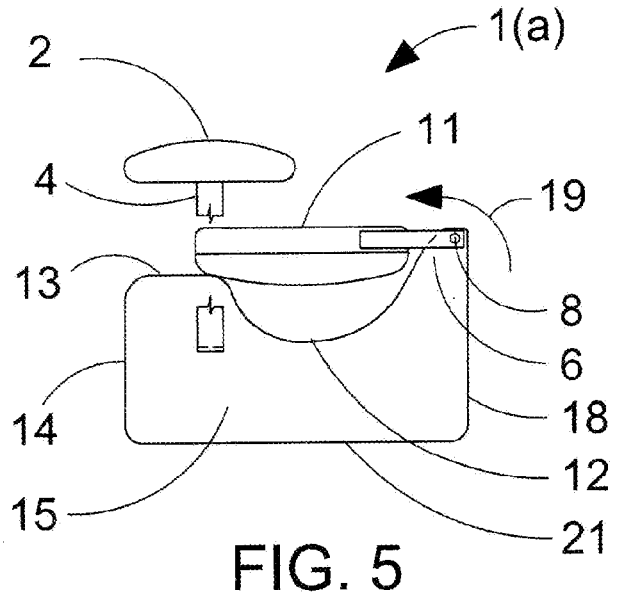
FIG. 5 is a left side view of the seating device in its compacted mode with the back panel having been folded downward to abut the top panel 13.
Figure 5A:
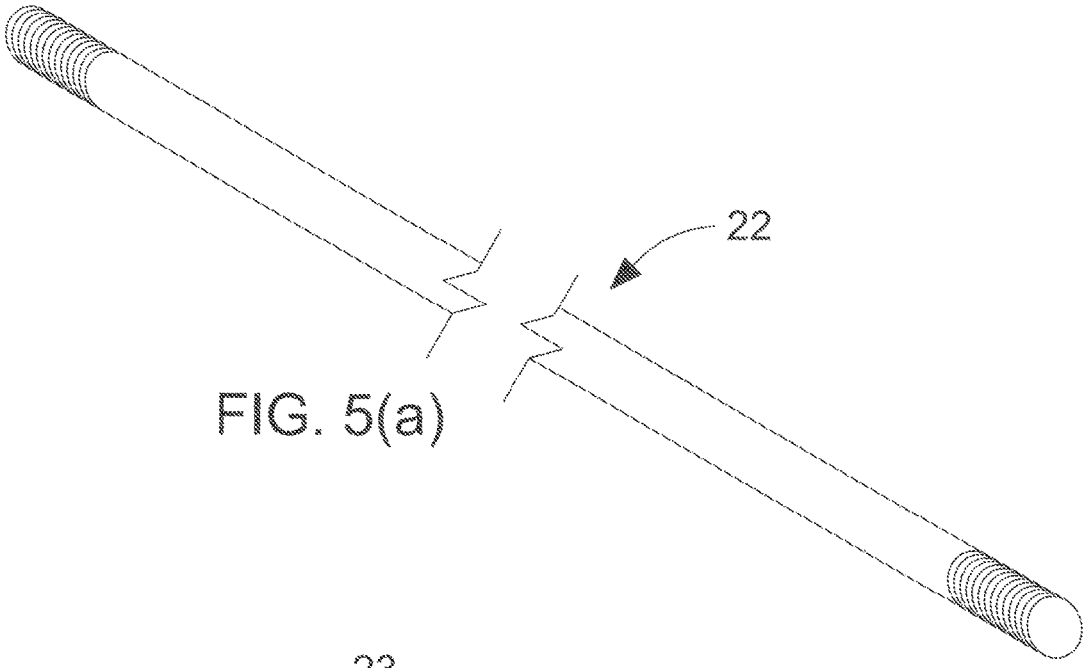
Figure 5B:
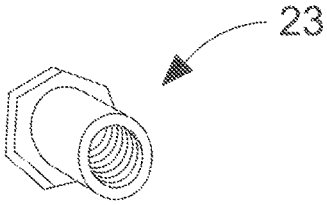
Figure 5C:
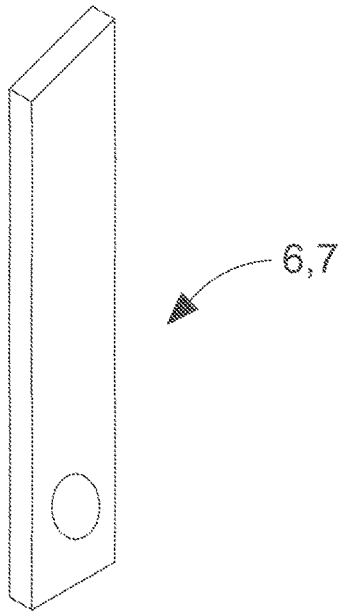

FIG. 5 depicts the seating device 1 in its compacted configuration, in which the back panel 11 and cushioned inner backrest 10 have been folded down from their previous vertical orientation into a horizontal orientation abutting the top panel 13 of the contoured recess 12.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

What is claimed is:

1. A lightweight, foldable, contoured seating device for placement on top of or within the confines of a chair, a sofa, couch, loveseat, vehicle seat, any structure intended for the purpose of seating an adult person, or atop a level, horizontal surface, the contoured seating device comprising:

a contoured recess comprising a solid, one-piece structure having a top panel, a left side panel, a right side panel, a front panel, a rear panel, and a continuous bottom edge which encompasses the bottom of the left side panel, the front panel, the right side panel, and the rear panel; a width-wise running upwardly-facing concave portion corresponding generally to the curvature of a person's buttocks;

a vertically oriented, rectangular back panel having a flexible cushioned inner backrest attached to one plane of said rectangular back panel by means of a common interfacing surface, said back panel positioned above the rear portion of the contoured recess and further having a width-wise horizontal space separating said back panel and the contoured recess;

left and right armrests; and left and right armrest supports, the armrest supports being fixed to the left side panel and the right side panel, respectively;

a means of hingedly attaching said back panel to the left side panel and right side panel, while leaving a horizontal space between the bottom of said back panel and the rear panel, such that the hinged rotation range of said back panel extends from a vertical orientation downward to a folded horizontal position with said inner backrest is flush against the top panel; such that in the functional use of the seating device being occupied by a user, the predominance of the user's weight is transmitted directly downward, via the user's hamstring muscles, onto the top panel, the user's back presses directly against said inner backrest so as to provide a sense of balance and stability, and the user's buttocks make no contact or minimal contact with the surface of the concave portion of the contoured recess.

2. The contoured seating device as in claim 1, further comprising a carry handle attached to the rear panel of the device.

3. The contoured seating device as in claim 1, further comprising a contoured recess with width dimensions in the range of 15.0 inches to 28.0 inches and a concave depth in the range of 4.0 inches to 10.0 inches; total back panel and rear panel combined height dimension in the range of 18.0 inches to 28.0 inches; and a front-to-back length in the range of 16.0 inches to 24.0 inches.

4. A lightweight, foldable, contoured seating device for placement on top of or within the confines of a chair, a sofa, couch, loveseat, vehicle seat, any structure intended for the purpose of seating an adult person, or atop a level, horizontal surface, the contoured seating device comprising:

a contoured recess comprising a solid, padded one-piece structure having a top panel, a left side panel, a right side panel, a front panel, a rear panel, and a continuous bottom edge which encompasses the bottoms of the left side panel, the front panel, the right side panel, and the rear panel; a width-wise running upwardly-facing concave portion corresponding generally to the curvature of a person's buttocks; a horizontally-oriented threaded opening proximate the rear of the left side panel and extending a distance inside the left side panel; a horizontally-oriented, interiorly-threaded opening proximate the rear of the right side panel and extending a distance inside the right side panel;

a vertically oriented, rectangular back panel having a flexible cushioned inner backrest attached to one plane of said rectangular back panel by means of a common interfacing surface, said back panel positioned above the rear portion of the contoured recess and further having a width-wise horizontal space separating said back panel and the contoured recess;

a left primarily longitudinal, planar hinge having an aperture proximate its first end and a right, primarily longitudinal, planar hinge having an aperture proximate its first end, wherein the second end of said left planar hinge and the second end of said right planar hinge are each permanently affixed to the lower left side and lower right said of said back panel, respectively;

a left hinge bolt and a right hinge bolt, each having exterior threads corresponding to the interior threads of said threaded opening of the left side panel and right side panel, respectively;

said left hinge and right hinge each being permanently attached to the respective left and right sides of the rear back, and said left and right hinges having apertures proximate one end of each respective hinge;

left and right armrests; and left and right armrest supports, the armrest supports being fixed to the left side panel and the right side panel, respectively; wherein said left and right hinge bolts are inserted through apertures in each respective hinge, said bolts thereupon being inserted into horizontally-oriented, corresponding threaded openings in the left side panel and right side panel, respectively, thereby enabling the folding of said inner backrest and back panel downward, and flush against the top panel; such that in the functional use of the seating device being occupied by a user, the predominance of the user's weight is transmitted directly downward, via the user's hamstring muscles, onto the top panel, the user's back presses directly against said inner backrest so as to provide a sense of balance and stability, and the user's buttocks make no contact or minimal contact with the surface of the concave portion of the contoured recess.

5. The contoured seating device as in claim 4, further comprising a carry handle attached to the rear panel of the device.

6. The contoured seating device as in claim 4, further comprising a contoured recess with width dimensions in the range of 15.0 inches to 28.0 inches and a concave depth in the range of 4.0 inches to 10.0 inches; total back panel and rear panel combined height dimension in the range of 18.0 inches to 28.0 inches: and a front-to-back length in the range of 16.0 inches to 24.0 inches.

7. A lightweight, foldable, contoured seating device for placement on top of or within the confines of a chair, a sofa, couch, loveseat, vehicle seat, any structure intended for the purpose of seating an adult person, or atop a level, horizontal surface, the contoured seating device comprising:

a contoured recess comprising a solid, padded one-piece structure having a top panel, a left side panel, a right side panel, a front panel, a rear panel, and a continuous bottom edge which encompasses the bottoms of the left side panel, the front panel, the right side panel, and the rear panel; a width-wise running upwardly-facing concave portion corresponding generally to the curvature of a person's buttocks; a horizontally-oriented circular channel extending the width of the seating device from the rearmost portion of the left side panel to the rearmost section of the right side panel;

a vertically oriented, rectangular back panel having a flexible cushioned inner backrest attached to one plane of said rectangular back panel by means of a common interfacing surface, said back panel positioned above the rear portion of the contoured recess and further having a width-wise horizontal space separating said back panel and the contoured recess;

a left, rectangular and primarily longitudinal planar hinge plate having an aperture proximate its first end and a right, rectangular and primarily longitudinal, planar hinge having an aperture proximate its first end, wherein the second end of said left planar hinge and the second end of said right planar hinge are each permanently affixed to the lower left side and lower right said of said back panel, respectively;

a circular cross-sectioned rod having a diameter corresponding to the inner diameter of said width-wise circular channel and a length corresponding to the length of said width-wise circular channel, the said circular rod further having exterior threads at both ends;

two threaded nuts having internal threading corresponding to the exterior threads of said circular rod;

left and right armrests; and left and right armrest supports, the armrest supports being fixed to the left side panel and the right side panel, respectively; wherein said circular rod is inserted into the circular channel and thereupon utilizes the two threaded nuts to fasten both ends of the circular rod securely against the left side panel and right side panel of the contoured recess, thereby enabling the folding of said inner backrest and back panel downward, and flush against the top panel; such that in the functional use of the seating device being occupied by a user, the predominance of the user's weight is transmitted directly downward, via the user's hamstring muscles onto the top panel, the user's back presses directly against said inner backrest so as to provide a sense of balance and stability, and the user's buttocks make no contact or minimal contact with the surface of the concave portion of the contoured recess.

8. The contoured seating device as in claim 7, further comprising a carry handle attached to the rear panel of the device.

9. The contoured seating device as in claim 7, further comprising a contoured recess with width dimensions in the range of 15.0 inches to 28.0 inches and a concave depth in the range of 4.0 inches to 10.0 inches; total back panel and rear panel combined height dimension in the range of 18.0 inches to 28.0 inches; and a front-to-back length in the range of 16.0 inches to 24.0 inches.

* * * * *